US009587870B2

(12) United States Patent
Cravens et al.

(10) Patent No.: US 9,587,870 B2
(45) **Date of Patent: *Mar. 7, 2017**

(54) ICE MAKER WITH HEATLESS ICE REMOVAL AND METHOD FOR HEATLESS REMOVAL OF ICE

(71) Applicant: Whirlpool Corporation, Benton Harbor, MI (US)

(72) Inventors: Charles R. Cravens, St. Joseph, MI (US); Vincent D. Csapos, Hamilton, MI (US); Yen-Hsi Lin, St. Joseph, MI (US); Xi Shan, Houston, TX (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/637,582

(22) Filed: Mar. 4, 2015

(65) Prior Publication Data

US 2015/0184914 A1 Jul. 2, 2015

Related U.S. Application Data

(63) Continuation of application No. 13/802,863, filed on Mar. 14, 2013, now Pat. No. 9,016,073.

(51) Int. Cl.
*F25C 1/04* (2006.01)
*F25C 1/22* (2006.01)
(Continued)

(52) U.S. Cl.
CPC ..... *F25C 1/04* (2013.01); *F25C 1/225* (2013.01); *F25C 1/24* (2013.01); *F25C 5/04* (2013.01); *F25C 5/06* (2013.01); *F25C 2600/04* (2013.01)

(58) Field of Classification Search
CPC .... F25C 1/04; F25C 1/24; F25C 1/225; F25C 2600/04; F25C 5/04; F25C 5/06
(Continued)

(56) References Cited

U.S. PATENT DOCUMENTS 1,932,731 A 10/1933 Hathorne
1,952,729 A 3/1934 Rawlings
(Continued)

FOREIGN PATENT DOCUMENTS

CN 201116809 Y 9/2008
CN 101377371 A 3/2009
(Continued)

*Primary Examiner* — Mohammad M Ali

(57) ABSTRACT

An ice making module for an appliance includes a conductive ice tray having an ice forming cavity. An electrical circuit is in electrical communication with the conductive ice tray and includes a power source in electrical communication with the conductive ice tray and a switch. The switch releases an electromagnetic pulse through the conductive ice tray. A water dispensing mechanism disposes water into the ice forming cavity and a cooling apparatus cools the water to form at least one ice piece that is in electromagnetic communication with the conductive ice tray. The electromagnetic pulse released through the conductive ice tray generates an induced electrical current through the ice piece and a repelling electromagnetic force between the conductive ice tray and the ice piece, wherein the repelling force biases the ice piece away from the conductive ice tray, thereby ejecting the ice piece from the ice forming cavity.

20 Claims, 7 Drawing Sheets

(51) Int. Cl.
*F25C 1/24* (2006.01)
*F25C 5/04* (2006.01)
*F25C 5/06* (2006.01)

(58) Field of Classification Search
USPC ..... 62/71, 340, 66, 350, 349, 344
See application file for complete search history.

(56) References Cited

U.S. PATENT DOCUMENTS

| | | | | |
|---|---|---|---|---|
| 2,191,263 | A | 2/1940 | Waring | |
| 2,227,700 | A | 1/1941 | Buchanan | |
| 2,512,759 | A | 6/1950 | Allen et al. | |
| 2,572,328 | A | 10/1951 | Field | |
| 3,018,636 | A | 1/1962 | Waag et al. | |
| 3,033,008 | A | 5/1962 | Davis | |
| 3,263,443 | A | 8/1966 | Frei, Sr. | |
| 3,545,717 | A | 12/1970 | Pietrzak | |
| 4,739,233 | A | 4/1988 | Marcade | |
| 5,177,980 | A | 1/1993 | Kawamoto et al. | |
| 5,297,394 | A | 3/1994 | Frohbieter et al. | |
| 5,411,121 | A | 5/1995 | LaForte et al. | |
| 5,582,754 | A | 12/1996 | Smith et al. | |
| 5,818,131 | A | 10/1998 | Zhang | |
| 6,041,607 | A | 3/2000 | Kim | |
| 6,092,374 | A | 7/2000 | Kang et al. | |
| 6,207,939 | B1 | 3/2001 | Allaire et al. | |
| 6,852,171 | B2 | 2/2005 | Downs | |
| 7,185,508 | B2 | 3/2007 | Voglewede et al. | |
| 7,703,300 | B2 | 4/2010 | Petrenko | |
| 7,905,466 | B2 | 3/2011 | Lee et al. | |
| 8,109,114 | B2 | 2/2012 | Lee et al. | |
| 8,405,002 | B2 | 3/2013 | Petrenko et al. | |
| 8,539,780 | B2 | 9/2013 | Herrera et al. | |
| 2001/0035342 | A1 | 11/2001 | Morse et al. | |
| 2008/0184720 | A1 | 8/2008 | Morgan et al. | |
| 2009/0165467 | A1* | 7/2009 | Kim | F25C 1/00 62/3.63 |
| 2009/0199569 | A1 | 8/2009 | Petrenko | |
| 2009/0235682 | A1 | 9/2009 | Petrenko et al. | |
| 2010/0011786 | A1 | 1/2010 | Shin et al. | |
| 2010/0083687 | A1 | 4/2010 | Handa et al. | |
| 2010/0206990 | A1 | 8/2010 | Petrenko | |
| 2010/0243767 | A1 | 9/2010 | Mori et al. | |
| 2011/0314842 | A1 | 12/2011 | Herrera et al. | |
| 2013/0074527 | A1* | 3/2013 | Joung | F25C 1/20 62/68 |

FOREIGN PATENT DOCUMENTS

| | | | |
|---|---|---|---|
| JP | 1139979 | A | 6/1989 |
| KR | 719256 | B1 | 5/2007 |

* cited by examiner

ICE MAKER WITH HEATLESS ICE REMOVAL AND METHOD FOR HEATLESS REMOVAL OF ICE

CROSS-REFERENCE TO RELATED APPLICATION

This application is a continuation of U.S. patent application Ser. No. 13/802,863, filed on Mar. 14, 2013, entitled "ICE MAKER WITH HEATLESS ICE REMOVAL AND METHOD FOR HEATLESS REMOVAL OF ICE," now U.S. Pat. No. 9,016,073, the entire disclosure of which is hereby incorporated herein by reference.

FIELD OF THE INVENTION

The invention is in the field of ice making modules for appliances, and specifically heatless removal of ice from ice modules for appliances.

BRIEF SUMMARY OF THE INVENTION

In one aspect, an ice making module for a refrigerator includes a conductive ice tray including at least one ice piece forming cavity that is defined by at least four side walls, at least one bottom surface, wherein the conductive ice tray has an outward surface and an inward surface. A barrier coating is disposed on at least a portion of the inward surface of the conductive ice tray. An electrical circuit is in electrical communication with the conductive ice tray, wherein the electrical circuit includes a power source and a capacitor, wherein the capacitor is in selective electrical communication with the conductive ice tray and selective electrical communication with the power source. A switch is in electrical communication with the power source, the capacitor, and the conductive ice tray, wherein the switch is configured to move between a charging position, wherein the capacitor is configured to selectively receive and store an electrical charge from the power source, and a pulse position, wherein the capacitor is configured to selectively release the electrical charge through the conductive ice tray in the form of an electromagnetic pulse. A conductive material is disposed proximate the inward surface of the conductive ice tray, wherein the conductive material is configured to be in selective electromagnetic communication with the conductive ice tray, and wherein the electromagnetic pulse selectively released by the capacitor through the conductive ice tray generates an induced electrical current through the conductive material and a repelling electromagnetic force between the conductive ice tray and the conductive material, wherein the repelling force biases the conductive material away from the at least one bottom surface of the conductive ice tray, thereby ejecting at least one ice piece from the at least one ice piece forming cavity. A water dispensing mechanism is configured to selectively dispose water into the at least one ice piece forming cavity of the conductive ice tray, wherein the barrier coating substantially provides a membrane between the water and the conductive ice tray, and wherein the ice tray is in communication with the water selectively disposed within the ice tray. A cooling apparatus is configured to selectively decrease the temperature of the water in the at least one ice piece forming cavity to a predetermined temperature, wherein the water is substantially solidified.

In another aspect, a refrigerator includes an ice making module and includes a conductive ice tray including at least four side walls, a bottom surface, and an inward surface, wherein the inward surface of the conductive ice tray defines a plurality of ice piece forming cavities. A barrier coating is disposed proximate at least a portion of the inward surface of the conductive ice tray. An electrical circuit is in electrical communication with the conductive ice tray, wherein the electrical circuit includes a power source and a capacitor, wherein the capacitor is in selective electrical communication with the conductive ice tray and selective electrical communication with the power source. A switch is in electrical communication with the power source, the capacitor, and the conductive ice tray, wherein the switch is configured to move between a charging position, wherein the capacitor is configured to selectively receive and store an electrical charge from the power source, a pulse position, wherein the capacitor is configured to selectively release the electrical charge through the conductive ice tray in the form of an electromagnetic pulse, and an idle position, wherein the capacitor is not in electrical communication with the power source or the conductive ice tray. A first magnetic field is selectively generated about the conductive ice tray when the switch is disposed in the pulse position. A conductive material is disposed proximate the inward surface of the conductive ice tray, wherein the conductive material is configured to be in selective electromagnetic communication with the conductive ice tray, and wherein the first magnetic field selectively generates an induced electrical current within, and a second magnetic field about, the conductive material, and wherein the first magnetic field opposes the second magnetic field, and wherein the opposing first and second magnetic fields bias the conductive material away from the bottom surface of the conductive ice tray, thereby ejecting at least one ice piece from the at least one ice piece forming cavity. A water dispensing mechanism is configured to selectively dispose water into the plurality of ice piece forming cavities of the conductive ice tray, wherein the barrier coating substantially provides a membrane between the water and the conductive ice tray, and wherein the ice tray is in communication with the water selectively disposed within the ice tray. A cooling apparatus is configured to decrease the temperature of the water in the plurality of ice piece forming cavities to a predetermined temperature, wherein the water is substantially solidified.

In yet another aspect, a method for heatless removal of ice pieces from a conductive ice tray includes the steps of providing a conductive ice tray including at least one ice piece forming cavity that is defined by at least four side walls, at least one bottom surface, wherein the conductive ice tray has an outward surface and an inward surface, wherein a barrier coating is disposed on at least a portion of the inward surface, adding liquid to the at least one ice piece forming cavity, forming at least one ice piece within the at least one ice piece forming cavity using a cooling capacity supplying system, disposing a conductive material proximate the inward surface of the conductive ice tray, wherein the conductive material is configured to be in selective electromagnetic communication with the conductive ice tray, charging a capacitor configured to selectively receive an electrical charge from a power source, wherein the capacitor is in selective electrical communication with the power source and selective electrical communication with the conductive ice tray and releasing an electromagnetic pulse using a switch to deliver an electromagnetic pulse from the capacitor through the conductive ice tray, thereby generating an induced electrical current through the conductive material and a repelling electromagnetic force between the conductive ice tray and the conductive material, thereby biasing the conductive material away from the at least one bottom surface of the conductive ice tray, and repelling the at least one ice piece from the at least one ice piece forming cavity.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

DETAILED DESCRIPTION OF EMBODIMENTS

Figure 1:
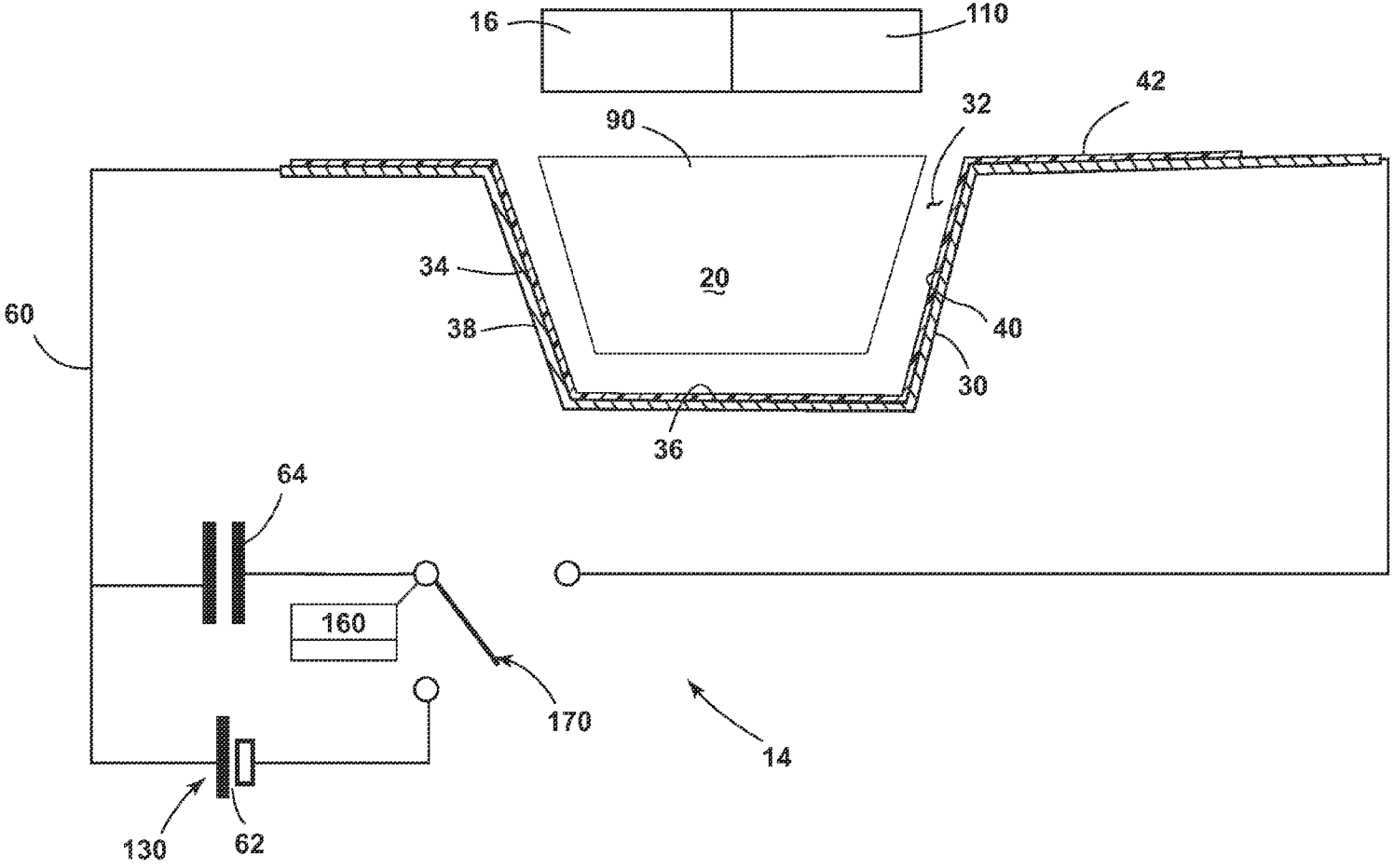
FIG. 1 is a schematic view of one embodiment of the ice maker with the switch in the idle position.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With respect to FIG. 1, a refrigerator 10 is generally shown. In each of these embodiments, the refrigerator 10 can have an interior 12. As will be more fully described below, the refrigerator 10 can also include an ice making module 14 in thermal communication with a cooling system 16, wherein the cooling system 16 provides cooling to the interior 18 of the ice making module 14 to make ice pieces 20.

A first aspect, as illustrated in FIG. 1 of one embodiment of the ice making module 14, includes a conductive ice tray 30 that has at least one ice piece forming cavity 32 that is defined by at least four sidewalls 34 and at least one bottom surface 36. The conductive ice tray 30 also has an outward surface 38 and an inward surface 40. A non-electrical conductive barrier coating 42 is disposed on at least a portion of the inward surface 40 of the conductive ice tray 30.

Referring now to FIGS. 1-4, the ice making module 14 also includes an electrical circuit 60 that is disposed in electrical communication with the conductive ice tray 30, where in the electrical circuit 60 includes a power source 62 and a capacitor 64. The capacitor 64 is in selective electrical communication with the conductive ice tray 30 and selective electrical communication with the power source 62. The electrical circuit 60 also includes a switch 66 disposed in electrical communication with the power source 62, the capacitor 64, and the conductive ice tray 30. The switch 66 is configured to move between a charging position 68 (shown in FIG. 3), wherein the capacitor 64 is configured to selectively receive and store an electrical charge from the power source 62, and a pulse position 70 (shown in FIG. 4), wherein the capacitor 64 is configured to selectively release the electrical charge through the conductive ice tray 30 in the form of an electromagnetic pulse 72.

Figure 2:
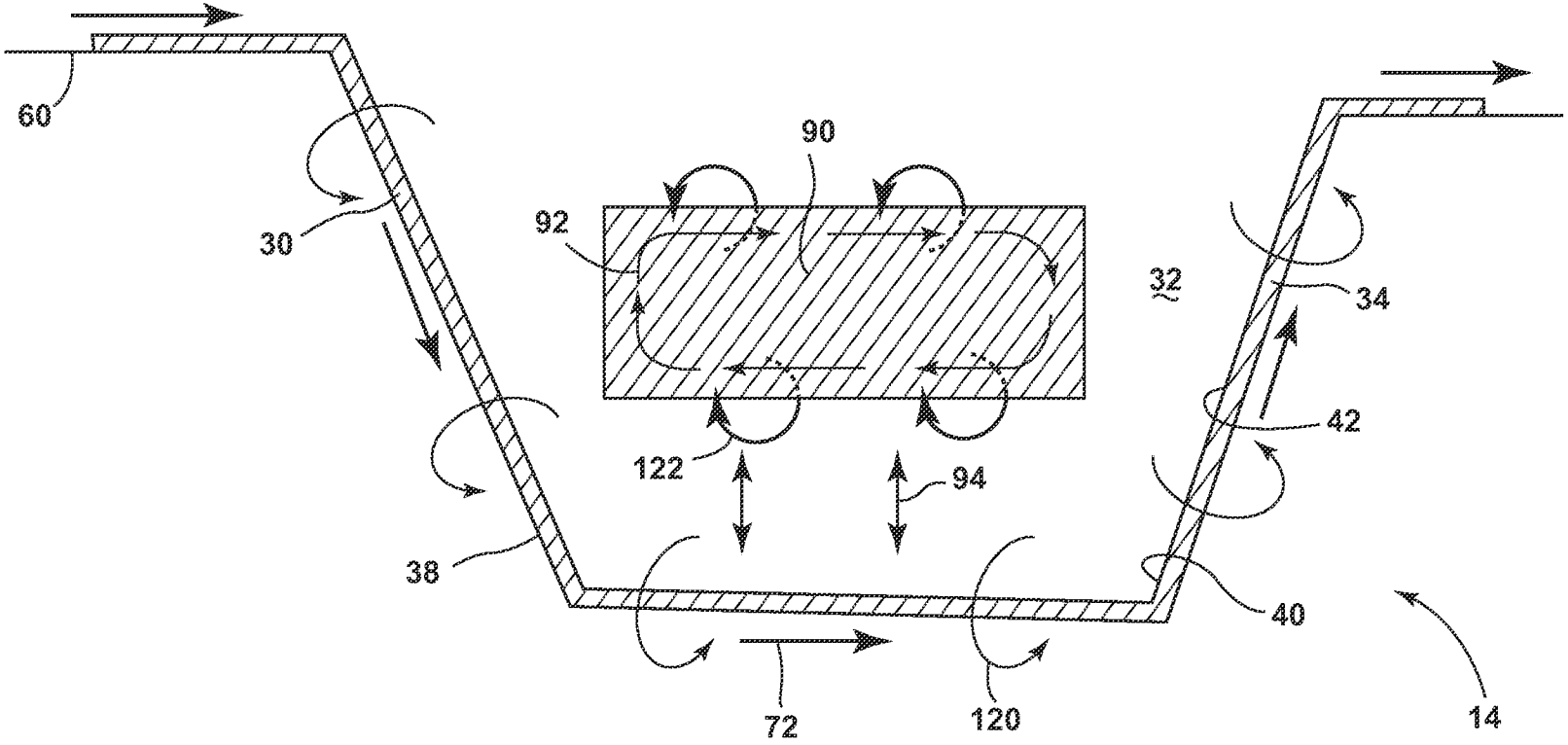
FIG. 2 is a schematic view of one embodiment of the ice maker with the switch in the pulse position.

As illustrated in FIGS. 1-4, a conductive material 90 is disposed proximate the inward surface 40 of the conductive ice tray 30, such that the conductive material 90 is configured to be in selective electromagnetic communication with the conductive ice tray 30. As will be more fully described below, the electromagnetic pulse 72 selectively released by the capacitor 64 through the conductive ice tray 30 generates an induced electrical current 92 through the conductive material 90. The electromagnetic pulse 72 through the capacitor 64 and the induced electrical current 92 through the conductive material 90 generates a repelling electromagnetic force 94 between the conductive ice tray 30 and the conductive material 90. The repelling electromagnetic force 94 biases the conductive material 90 away from the at least one bottom surface 36 of the conductive ice tray 30. In this manner, at least one ice piece is ejected from the at least one ice piece forming cavity 32. As illustrated in FIG. 2, the flow of electricity through the electrical circuit 60 generates the repelling electromagnetic force 94 to repel the at least one ice piece 20 from the at least one ice piece forming cavity 32, such that heat and torsional forces are not used to remove the ice pieces 20 from the ice piece forming cavity or cavities 32 of the conductive ice tray 30.

As illustrated in the embodiment of FIG. 1, the ice making module 14 also includes a water dispensing mechanism 110 that is configured to selectively dispose water into the at least one ice piece forming cavity 32 of the conductive ice tray 30. The barrier coating 42 disposed on the conductive ice tray 30 substantially provides a membrane between the water and the conductive ice tray 30. The conductive ice tray 30 is configured to be in communication with the water that is selectively disposed within the conductive ice tray 30 by the water dispensing mechanism 110. In addition, the cooling system 16 is configured to be in thermal communication with the at least one ice piece forming cavity 32 and the water that is selectively disposed within the at least one ice piece forming cavity 32. In this manner, the cooling system 16 is configured to selectively decrease the temperature of the water in the at least one ice piece forming cavity 32 such that the water is substantially solidified into the at least one ice piece 20.

In the various embodiments, the conductive ice tray 30 forms at least a part of the electrical circuit 60, wherein the conductive ice tray 30 can be made of highly electrically conductive materials 90 that can include, but are not limited to, aluminum and aluminum alloys, steel alloys, copper and copper alloys, and other highly electrically conductive materials 90. In addition, the conductive ice tray 30 can be configured in varying shapes that can include, but are not limited to, arcuate shapes, polygonal shapes, or irregular shapes.

Referring again to the illustrated embodiment as shown in FIGS. 1-4, the capacitor 64 is charged by the power source 62 when the switch 66 is in the charging position 68. When the switch 66 is moved to the pulse position 70, the capacitor 64 releases the electromagnetic pulse 72 through the electrical circuit 60 and the conductive ice tray 30. The flow of the electromagnetic pulse 72 through the conductive ice tray 30 generates a rapidly changing magnetic field 120 around the conductive ice tray 30. The rapidly changing magnetic field 120 generates the induced electrical current 92 within the conductive material 90 disposed in electromagnetic communication with the conductive ice tray 30. In this manner, the induced electrical current 92 in the conductive material 90 generates an induced magnetic field 122 around the conductive material 90. The rapidly changing magnetic field 120 around the conductive ice tray 30 and the induced magnetic field 122 around the conductive material 90 are opposing magnetic fields, thereby generating the repelling electromagnetic force 94 that ejects the at least one ice piece from the barrier coating 42 that is disposed on at least a portion of the surface of the conductive ice tray 30. The barrier coating 42 is configured to substantially decrease the adhesive force between the ice pieces 20 and the conductive ice tray 30, such that a lesser repelling force is required to remove the ice pieces 20 from the barrier coating 42 than would be necessary to remove the ice pieces 20 from the metallic surface of the conductive ice tray 30.

As illustrated in FIGS. 1 and 2, in various embodiments, the conductive material 90 can be the water that is selectively disposed within the at least one ice piece forming cavity 32. The water, in liquid or solid form, is a conductive material 90 and will generate the induced electrical current 92 and the resulting induced magnetic field 122 as a result of the electromagnetic pulse 72 from the capacitor 64 flowing through the conductive ice tray 30. In this embodiment, after the water in the at least one ice piece forming cavity 32 has become solidified and after the capacitor 64 has collected a predetermined charge 130 from the power source 62, the capacitor 64 rapidly discharges the stored electrical charge through the conductive ice tray 30 resulting in the repelling electromagnetic force 94 that repels the solid water in the form of the at least one ice piece 20 upward from the bottom surface 36 of the conductive ice tray 30. In other embodiments, other liquids can be used to create different flavors or colors of ice pieces 20 so long as the liquid being used is sufficiently conductive to generate the induced electrical current 92 and the resulting induced magnetic field 122 when the electromagnetic pulse 72 is released through the conductive ice tray 30. Such liquids can include, but are not limited to, juices, flavored waters, alcohol, and other conductive liquids.

Figure 3:
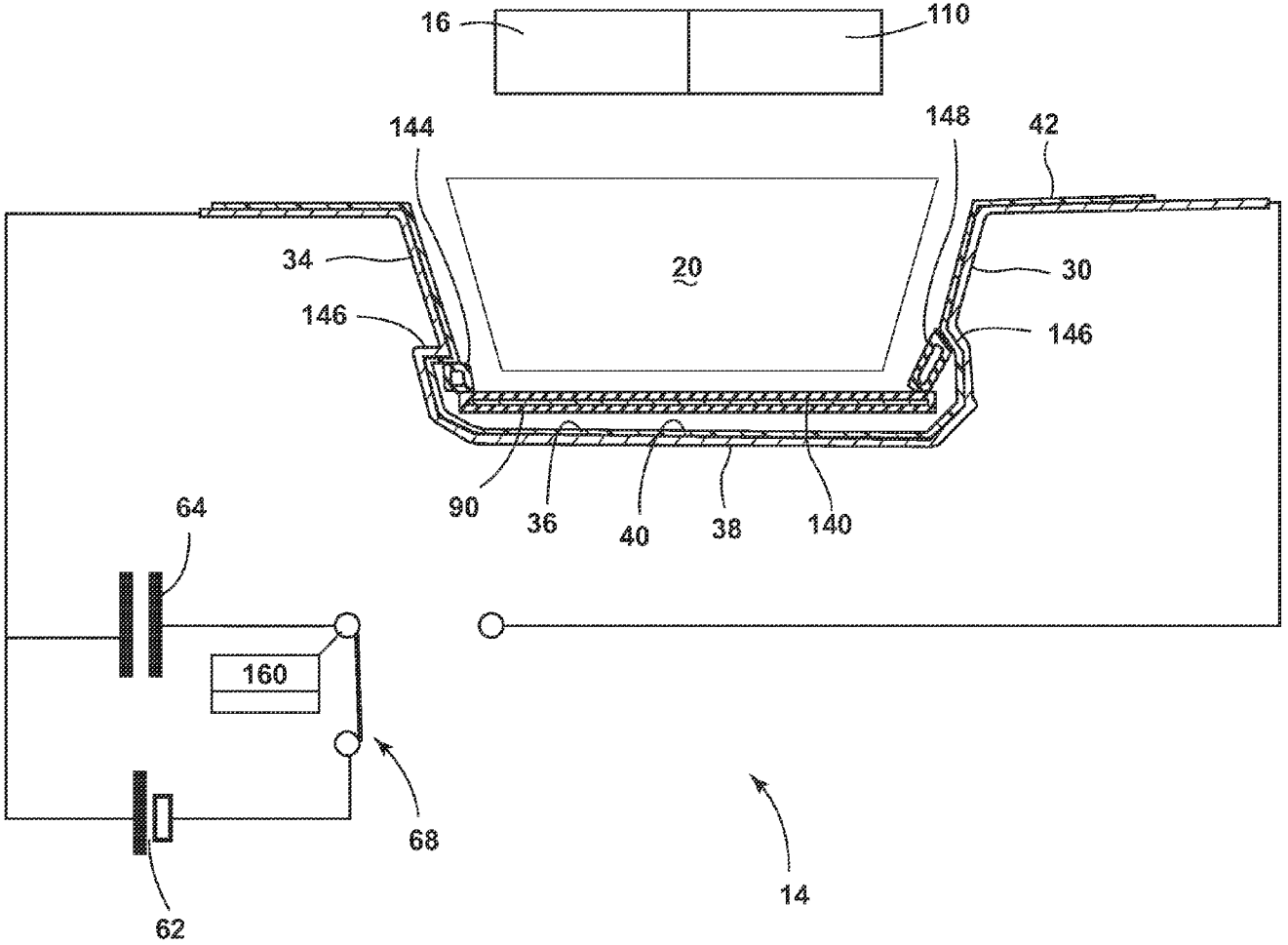
FIG. 3 is a schematic view of another embodiment of the ice maker with the switch in the charging position.
Figure 4:
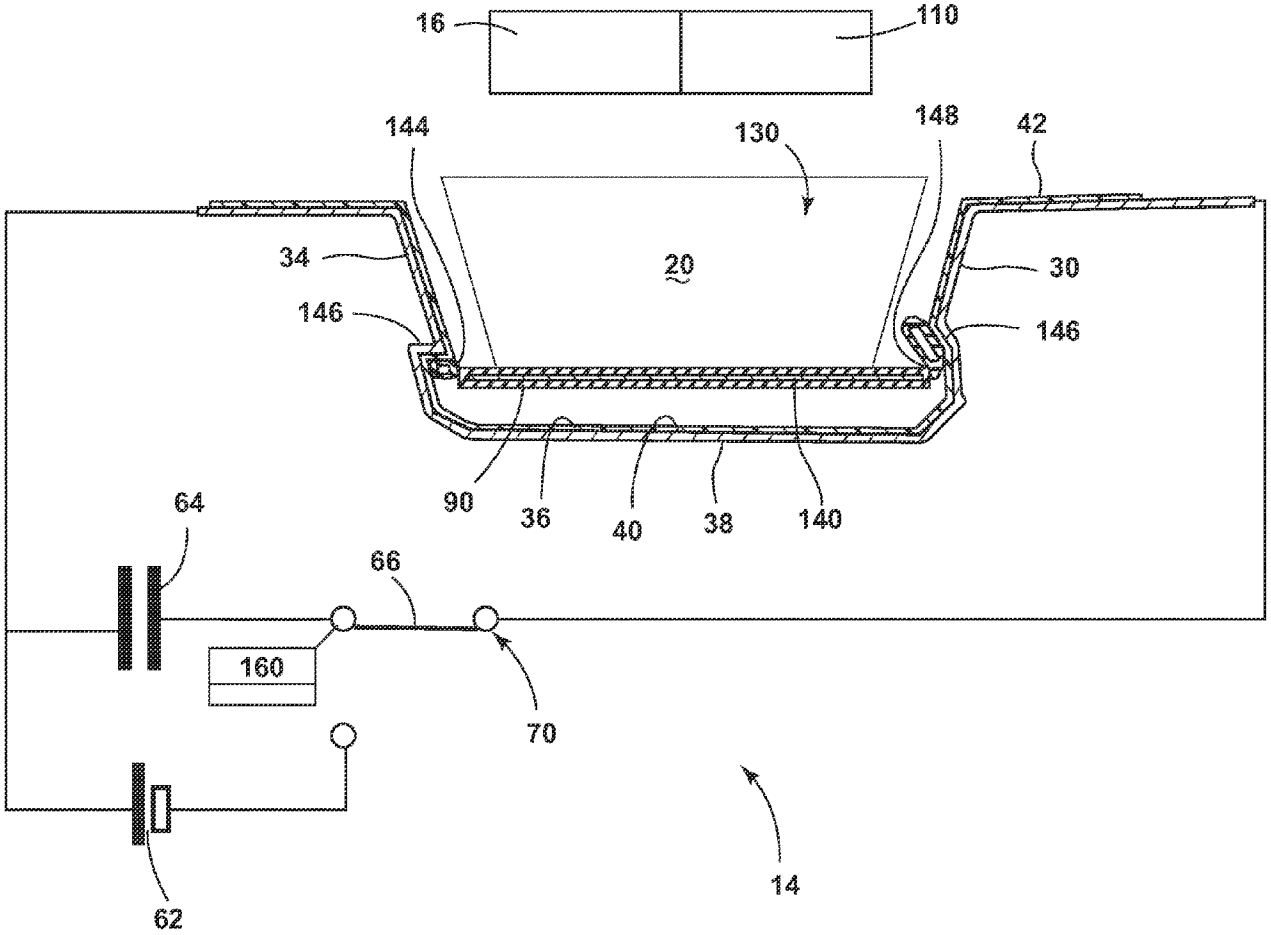
FIG. 4 is a schematic view of the ice maker of FIG. 3 with the switch in the pulse position.

As illustrated in the embodiment of FIGS. 2-4, the conductive material 90 can be a separate conductive biasing pad 140 disposed proximate the bottom surface 36 of the conductive ice tray 30. In this embodiment, the conductive ice tray 30 includes a protruding portion 142 that is defined by the at least four sidewalls 34 and the at least one bottom surface 36 of the conductive ice tray 30, wherein the protruding portion 142 is disposed proximate the at least one bottom surface 36. The protruding portion 142 of the conductive ice tray 30 is configured to be of a substantially sufficient size to permit the selective vertical movement of the conductive biasing pad 140 within the protruding portion 142 when the electromagnetic pulse 72 flows through the conductive ice tray 30. A biasing cushion 144 is disposed within the protruding portion 142 proximate an upper surface 146 of the protruding portion 142 of the conductive ice tray 30. The biasing cushion 144 is configured to receive a biasing surface 148 of the conductive biasing pad 140 such that the biasing cushion 144 substantially limits the upward movement of the biasing pad within the protruding portion 142, but also allows for the vertical movement of the conductive biasing pad 140 within a predetermined range of vertical movement. The predetermined range of vertical movement is substantially sufficient to repel the at least one ice piece 20 from the at least one ice piece forming cavity 32. In this manner, as the electromagnetic pulse 72 from the capacitor 64 flows through the conductive ice tray 30, the at least one ice piece 20 is ejected from the at least one ice piece forming cavity 32 without the addition of heat or a torsional force, or both being applied to the conductive ice tray 30. As the conductive biasing pad 140 is repelled from the bottom surface 36 of the conductive ice tray 30, the biasing cushion 144 is compressed between the upper surface 146 of the protruding portion 142 of the conductive ice tray 30 and the biasing surface 148 of the conductive biasing pad 140. In this manner, the biasing cushion 144 substantially limits the upward movement of the conductive biasing pad 140 so that the conductive biasing pad 140 does not substantially collide with the upper surface 146 of the protruding portion 142. In various embodiments, multiple electromagnetic pulses 72 can be released from the capacitor 64 where a single electromagnetic pulse 72 is not substantially sufficient to result in the ice pieces 20 being ejected from the ice piece forming cavities 32.

In various embodiments, the conductive biasing ice pad 140 can be made of a highly electrically conductive material 90 that can include, but is not limited to, aluminum and aluminum alloys, steel, copper and copper alloys, or other highly electrically conductive material 90.

As illustrated in FIGS. 3 and 4, the conductive biasing pad 140 is disposed within the protruding portion 142 above the barrier coating 42 that is disposed on at least a portion of the inward surface 40 of the conductive ice tray 30. In various alternate embodiments, the conductive biasing pad 140 can be disposed under the barrier coating 42 such that when the ice pieces 20 are formed within the ice piece forming cavity 32 the ice pieces 20 adhere only to the barrier coating 42 and not the conductive ice tray 30 or the conductive biasing pad 140. In such an embodiment, as discussed above, the barrier coating 42 permits the ice pieces 20 to be ejected from the at least one ice piece forming cavity 32 using a lesser force than if the ice pieces 20 were adhered to either the conductive ice tray 30 or the conductive biasing pad 140, or both. In other alternate embodiments, a separate membrane can be disposed over the conductive biasing pad 140, wherein the separate membrane is configured such that the at least one ice piece 20 adheres to the separate membrane with a lesser adhesive force than if the at least one ice piece 20 were to adhere to the conductive biasing pad 140.

As illustrated in FIGS. 1 and 3-4, the ice making module 14 includes a control 160 that is configured to be in fluid communication with the switch 66 of the electrical circuit 60. The control 160 is configured to selectively move the switch 66 between the charging and pulse positions 68, 70. The control 160 is configured to move the switch 66 to the pulse position 70 after the electrical charge in the capacitor 64 has reached a predetermined charge 130 and the temperature of the water has fallen below a predetermined temperature 162. In various embodiments, the predetermined charge 130 is an electrical charge of sufficient strength such that when released from the capacitor 64 the predetermined charge 130 will generate the repelling electromagnetic force 94 as described above without causing substantial deformation to the conductive ice tray 30 or the conductive biasing pad 140. The predetermined charge 130 can vary based upon several factors that can include, but are not limited to, the material being cooled, the size of the desired ice piece, and other factors. The predetermined temperature 162 is a temperature that will result in water becoming solidified thereby creating the ice pieces 20. The predetermined temperature 162 may vary depending upon various factors that include, but are not limited to, a desired ice temperature, the altitude at which the refrigerator 10 is being used, and other factors. Typically, the predetermined temperature 162 will be approximately the freezing point of water or below. The control 160 is further configured to move the switch 66 to the charging position 68 when the electrical charge within the capacitor 64 falls below the predetermined charge 130.

In the various embodiments, to assist the control 160 in monitoring the charge within the capacitor 64 and the temperature of the water within the ice piece forming cavities 32, the ice making module 14 can include one or more sensors configured to monitor the charge within the capacitor 64 and to monitor the temperature of the water within the at least one ice piece forming cavity 32. These sensors can be configured to be in communication with the control 160. In alternate embodiments, the temperature of the water within the at least one ice piece forming cavity 32 can be monitored by the lapsed time that the cooling system 16 has applied cooling to the water within the at least one ice piece forming cavity 32. In such an embodiment, the control 160 will not move the switch 66 to the pulse position 70 until a substantially sufficient time has passed to allow the cooling system 16 to sufficiently decrease the temperature of the water within the ice piece forming cavities 32 such that the water solidifies and forms the ice pieces 20.

In some embodiments, the temperature will not be monitored in all of the ice piece forming cavities 32. For example, it may be preferable to only measure the temperature in one ice piece forming cavity 32. This may be done by directly measuring the temperature in the ice piece forming cavity 32, or indirectly, by measuring a temperature proximate or in thermal connectivity with the ice piece forming cavity 32. Additionally, it may be advantageous to ensure that the ice piece forming cavity or cavities 32 measured for freeze is/are either the last to freeze or freeze close to the same time as the rest of the ice piece forming cavities 32 freeze. In such an embodiment, the measured ice piece forming cavity or cavities 32 have more water, or at least the same amount of water, as the others. Other methods for measuring temperature include, but are not limited to, making the measured ice piece forming cavities 32 slightly larger than the others, filling the measured ice piece forming cavity or cavities 32 before the non-measured ice piece forming cavity or cavities 32, or making the measured ice piece forming cavity or cavities 32 lower and/or deeper than the non-measured ice piece forming cavity or cavities 32, or combinations thereof.

As illustrated in the embodiment of FIG. 1, the switch 66 can also include an idle position 170, wherein when the switch 66 is in the idle position 170 the capacitor 64 is not in electrical communication with the power source 62 or the conductive ice tray 30. In this embodiment, the control 160 is configured to move the switch 66 to the idle position 170 when the capacitor 64 has stored the predetermined charge 130 and the temperature of the water in the ice piece forming cavity or cavities 32 has not become solidified.

Figure 5:
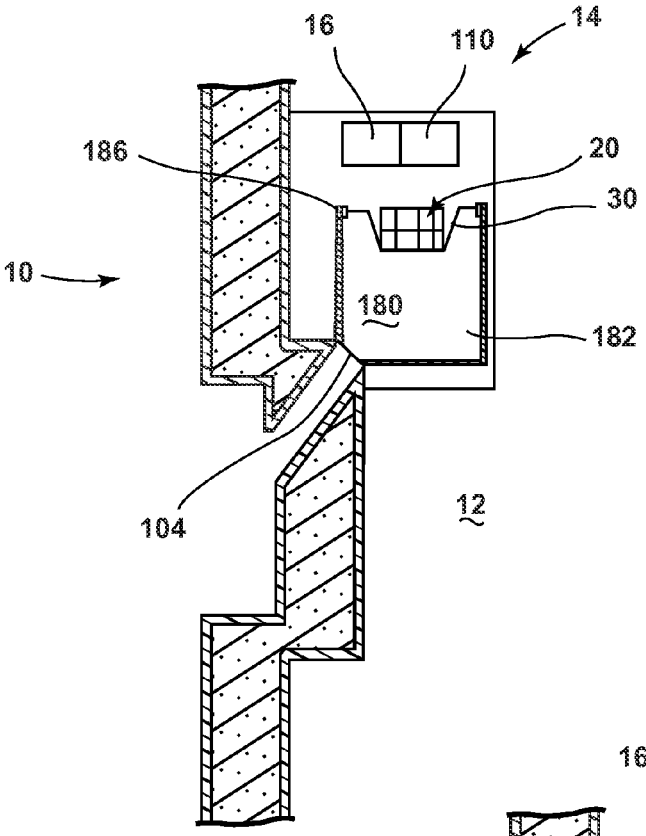
FIG. 5 is a schematic view of an embodiment of the conveyor mechanism of the ice maker.
Figure 6:
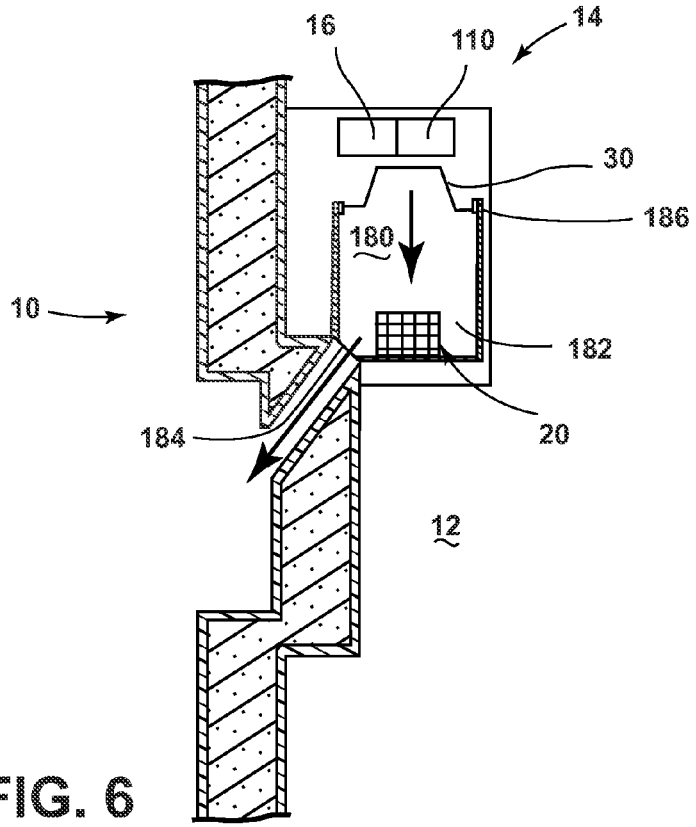
FIG. 6 is a schematic view of the conveyor mechanism of the ice maker of FIG. 5.

As illustrated in FIGS. 5 and 6, the ice making module 14 can include an ice conveyor 180 configured to selectively direct the ice pieces 20 that have been repelled from the conductive ice tray 30 to an ice piece storing container 182. The ice conveyor 180 can include a rotating member 186 that is disposed proximate the conductive ice tray 30, wherein the rotating member 186 is configured to rotate the conductive ice tray 30 after the ice pieces 20 have been repelled from the conductive ice tray 30 such that the ice pieces 20 are gravity-fed into an ice piece storing container 182 that is disposed below the conductive ice tray 30. In alternate embodiments, the ice conveyor 180 can include various other members for moving the ice pieces 20 from the conductive ice tray 30 to the ice piece storing container 182 that can include, but are not limited to, pushing members, apertures, operable panels, or other members that are configured to move the ice pieces 20 or allow the ice pieces 20 to move from the conductive ice tray 30 to the ice piece storing container 182. The ice piece storing container 182 is configured to provide for the movement of ice pieces 20 from the ice piece storing container 182 out of the ice making module 14 through an access aperture 184, such that a user of the refrigerator 10 can collect the ice pieces 20.

In various embodiments, the ice making module 14 can include different types of cooling systems 16 for decreasing the temperature of the water within the ice piece forming cavity or cavities 32. The types of cooling systems 16 that can be implemented include, but are not limited to, systems that provide thermoelectric cooling, magnetic cooling, vortex cooling, evaporative cooling, and other types of cooling methods.

Figure 7:
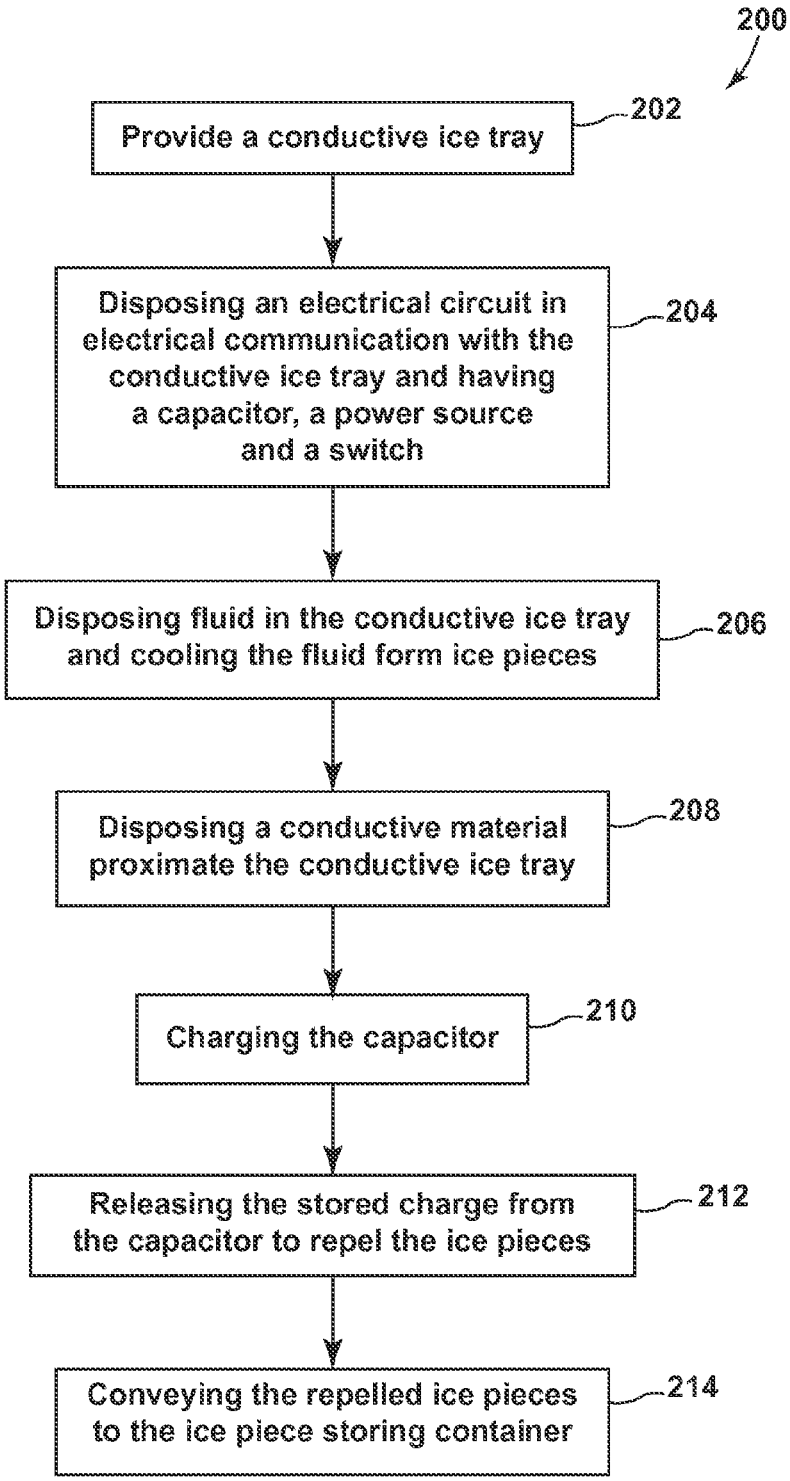
FIG. 7 is a flow chart diagram of one embodiment of a method for heatlessly repelling ice from a conductive ice tray.

In another aspect of the ice making module, as illustrated in FIG. 7, includes a method 200 for heatless removal of ice pieces 20 from a conductive ice tray 30. The method 200 includes the step 202 of providing a conductive ice tray 30 that includes at least one ice piece forming cavity 32 that is defined by at least four sidewalls 34, at least one bottom surface 36, and wherein the conductive ice tray 30 has an outward surface 38 and an inward surface 40, wherein a barrier coating 42 is disposed on at least a portion of the inward surface 40.

The method 200 also includes a step 204 of providing the electrical circuit 60 in electrical communication with the conductive ice tray 30. The electrical circuit 60 includes the capacitor 64, the power source 62, and the switch 66 wherein the switch 66 is in electrical communication with the conductive ice tray 30, the capacitor 64 and the power source 62. The switch 66 is operable between the charging position 68, wherein the power source 62 is in electrical communication with the capacitor 64, the pulse position 70, wherein the capacitor 64 is in electrical communication with the conductive ice tray 30, and the idle position 170, wherein the capacitor 64 is not in electrical communication with the power source 62 or the conductive ice tray 30. As will be more fully described below, this step 204 can also include providing a control 160 to operate the switch 66 of the electrical circuit 60.

Another step 206 in the method 200 includes disposing a liquid to the at least one ice piece forming cavity 32 and forming at least one ice piece 20 within the at least one ice piece forming cavity 32 using the cooling system 16.

The method 200 also includes a step 208 of disposing the conductive material 90 proximate the inward surface 40 of the conductive ice tray 30, wherein the conductive material 90 is configured to be in selective electromagnetic communication with the conductive ice tray 30. As discussed above, the conductive material 90 can include a conductive liquid that includes, but is not limited to, water, juice, alcohol, or other conductive liquids, and can also include a conductive solid that can include, but is not limited to, aluminum, steel, copper, or other conductive material.

Another step 210 of the method 200 includes charging a capacitor 64 that is configured to selectively receive an electric charge from a power source 62.

The next step 212 of the method 200 includes releasing the stored charge within the capacitor 64 in the form of an electromagnetic pulse 72 using a switch 66 to deliver the electromagnetic pulse 72 from the capacitor 64 through the conductive ice tray 30. As discussed above, when switch 66 is moved to the pulse position 70 and the electromagnetic pulse 72 is released, the electromagnetic pulse 72 flowing through the conductive ice tray 30 generates a rapidly changing magnetic field 120 around the conductive ice tray 30 that in turn generates an induced electrical current 92 through the conductive material 90 and resulting induced magnetic field 122 around the conductive material 90. The rapidly changing magnetic field 120 around the conductive ice tray 30 and the induced magnetic field 122 around the conductive material 90 are opposing magnetic fields that result in the repelling electromagnetic force 94 between the conductive ice tray 30 and the conductive material 90, thereby biasing the conductive material 90 away from the bottom surface 36 of the conductive ice tray 30 and repelling the at least one ice piece 20 from the at least one ice piece forming cavity 32.

Another step 214 in the method 200 includes selectively conveying the at least one ice piece 20 that has been repelled from the conductive ice tray 30 to the ice piece storing container 182 using an ice conveyor 180 as discussed above. The ice piece storing container 182 is configured to receive the ice pieces 20 from the conductive ice tray 30 and to selectively dispense the ice pieces 20 from the ice making module 14 through the access aperture 184 of the ice making module 14.

Figure 8:
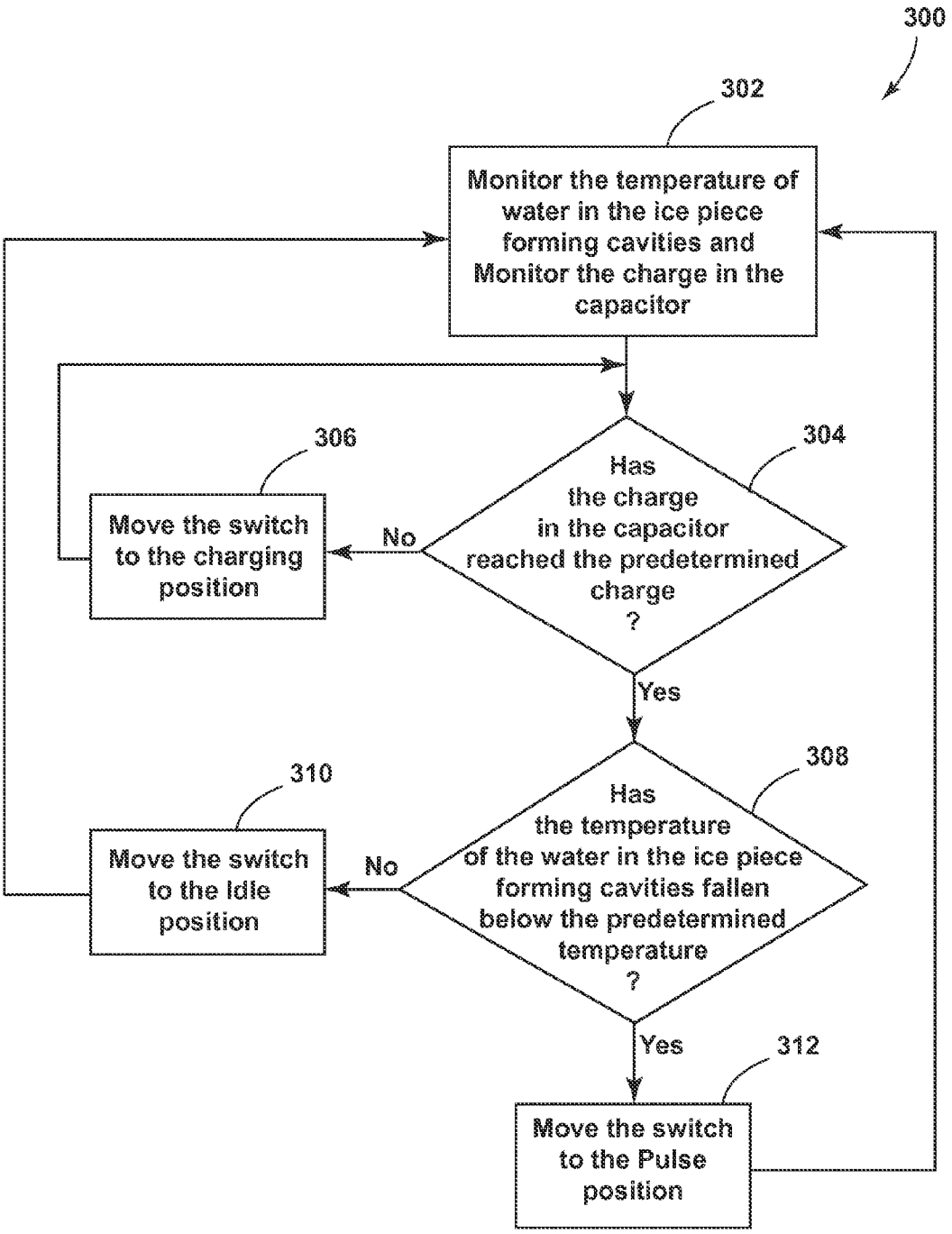
FIG. 8 is a flow chart diagram of one embodiment of a method for operating an electrical circuit for heatlessly repelling ice from a conductive ice tray.

As illustrated in FIGS. 7 and 8, the method 200 can be operated, at least in part, through the use of a control 16. FIG. 8, illustrates a method 300 for controlling the switch 66 to repel the ice pieces 20 from the conductive ice tray 30. In the first step 302 of the method 300, various sensors within the ice making module 14 monitor the charge within the capacitor 64 and the temperature of the water within the at least one ice piece forming cavity 32. The method 300 includes the step 304 of determining whether the charge in the capacitor 64 has reached the predetermined charge 130. If not, the next step 306 is for the control 160 to move the switch 66 to the charging position 68 so that the power source 62 can add additional electrical charge to the capacitor 64. Once the control 160 determines that the charge in the capacitor 64 has reached the predetermined charge 130, the next step 308 is for the control 160 to determine whether the water in the ice piece forming cavity or cavities 32 has fallen below the predetermined temperature 162. If the temperature of the water in the ice piece forming cavity or cavities 32 has not fallen below the predetermined temperature 162, the next step 310 in the method 300 is for the control 160 to move the switch 66 to the idle position 170 so that the water can receive additional cooling from the cooling system 16. Once the temperature of the water in the ice piece forming cavity or cavities 32 has fallen below the predetermined temperature 162 and the charge in the capacitor 64 has reached the predetermined charge 130, the next step 312 in the method 300 is for the control 160 to move the switch 66 to the pulse position 70 and the stored charge in the capacitor 64 is released into the electrical circuit 60 and the conductive ice tray 30. While the switch 66 is in the idle position 170, the charge within the capacitor 64 may diminish such that the charge within the capacitor 64 falls below the predetermined charge 130 without the switch 66 being moved to the pulse position 70. Such an occurrence can result in the control 160 monitoring the decrease in the charge within the capacitor 64 and moving the switch 66 to the charge position such that the power source 62 can deliver an additional charge to the capacitor 64 such that the charge within the capacitor 64 can reach the predetermined charge 130.

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

The invention claimed is:

1. An ice making module for a kitchen appliance, the ice making module comprising:

a conductive ice tray including at least one ice piece forming cavity wherein the conductive ice tray has an outward surface and an inward surface;

an electrical circuit in electrical communication with the conductive ice tray, wherein the electrical circuit includes a power source in selective electrical communication with the conductive ice tray;

a switch in electrical communication with the power source and the conductive ice tray, wherein the switch is configured to selectively release an electrical charge through the conductive ice tray in the form of an electromagnetic pulse;

a water dispensing mechanism configured to selectively dispose water into the at least one ice piece forming cavity of the conductive ice tray, and wherein the conductive ice tray is in communication with the water selectively disposed within the conductive ice tray; and a cooling apparatus configured to selectively decrease the temperature of the water in the at least one ice piece forming cavity so that the water is substantially solidified to form at least one ice piece, wherein the at least one ice piece is configured to be in selective electromagnetic communication with the conductive ice tray, and wherein the electromagnetic pulse selectively released through the conductive ice tray generates an induced electrical current through the at least one ice piece and a repelling electromagnetic force between the conductive ice tray and the at least one ice piece, wherein the repelling electromagnetic force biases the at least one ice piece away from the at least one bottom surface of the conductive ice tray, thereby ejecting at least one ice piece from the at least one ice piece forming cavity.

2. The ice making module of claim 1, further comprising:

a barrier membrane disposed on at least a portion of the inward surface of the conductive ice tray, wherein the barrier membrane provides a separating layer between the at least one ice piece and the conductive ice tray.

3. The ice making module of claim 1, wherein the electrical circuit includes a capacitor is selective electrical communication with the power source and the switch, wherein the capacitor receives and stores an electrical charge from the power source and the switch causes the capacitor to release the electrical charge in the form of the electromagnetic pulse, further comprising:

a protruding portion of the conductive ice tray defined by a bottom surface of the conductive ice tray, wherein a conductive biasing pad is disposed within the protruding portion of the conductive ice tray and is configured for selective vertical movement within the protruding portion when the electromagnetic pulse flows through the conductive ice tray; and a biasing cushion proximate at least a portion of an upper surface of the protruding portion and configured to receive a biasing surface of the conductive biasing pad, wherein the biasing cushion is further configured to substantially limit upward movement of the biasing pad caused by the repelling electromagnetic force beyond a predetermined distance, wherein the predetermined distance is substantially sufficient to repel the at least one ice piece from the at least one ice piece forming cavity, and wherein the at least one ice piece is ejected from the at least one ice piece forming cavity without the addition of at least one of heat and a torsional force applied to the conductive ice tray.

4. The ice making module of claim 3, wherein the switch is further configured to move between a charging position, wherein the capacitor is configured to selectively receive and store an electrical charge from the power source, and a pulse position, wherein the capacitor is configured to release the electrical charge.

5. The ice making module of claim 1, further comprising:

an ice conveyor configured to selectively direct the at least one ice piece that has been repelled from the conductive ice tray to an ice piece storage container, wherein the ice piece storage container is configured to selectively dispense the at least one ice piece from the ice making module, through an access aperture.

6. The ice making module of claim 4, wherein the switch includes an idle position, wherein the capacitor is not in electrical communication with the power source or the conductive ice tray, and wherein the switch moves to the idle position when the capacitor has stored a predetermined charge and a temperature of the water in the at least one ice piece forming cavity has not fallen below a predetermined freezing temperature.

7. The ice making module of claim 4, further comprising:

a control in electrical communication with the switch and configured to move the switch between the charging and pulse positions, wherein the control is configured to move the switch to the pulse position after the electrical charge in the capacitor reaches a predetermined charge and the temperature of the water falls below the predetermined temperature, wherein the control is further configured to move the switch to the charging position when the electrical charge in the capacitor falls below the predetermined charge, and wherein the switch includes an idle position, wherein the capacitor is not in electrical communication with the power source or the conductive ice tray, and wherein the control is configured to move the switch to the idle position when the capacitor has stored a predetermined charge and a temperature of the water in the at least one ice piece forming cavity has not fallen below a predetermined temperature.

8. The ice making module of claim 5, wherein the ice conveyor includes a rotating member disposed proximate the conductive ice tray, wherein the rotating member is configured to rotate the conductive ice tray after the at least one ice piece has been repelled from the conductive ice tray, wherein the at least one ice piece is gravity fed into the ice piece container disposed below the conductive ice tray.

9. A kitchen appliance including an ice making module, the kitchen appliance comprising:

a conductive ice tray including a plurality of ice piece forming cavities;

an electrical circuit in electrical communication with the conductive ice tray, wherein the electrical circuit includes a power source and a capacitor, wherein the capacitor is in selective electrical communication with the conductive ice tray and selective electrical communication with the power source, wherein the capacitor selectively receives and stores an electrical charge from the power source and is further configured to selectively release the electrical charge through the conductive ice tray in the form of an electromagnetic pulse that generates a first magnetic field about the conductive ice tray; and a conductive material disposed proximate an inward surface of the conductive ice tray, wherein the conductive material is configured to be in selective electromagnetic communication with the conductive ice tray, and wherein the first magnetic field selectively generates an induced electrical current within, and a second magnetic field around, the conductive material, and wherein the first magnetic field opposes the second magnetic field, and wherein the opposing first and second magnetic fields bias the conductive material away from the bottom surface of the conductive ice tray, thereby ejecting at least one ice piece from the plurality of ice piece forming cavities.

10. The kitchen appliance of claim 9, wherein the conductive material is water that is selectively disposed in the plurality of ice piece forming cavities, and wherein a cooling apparatus is configured to decrease a temperature of the water in the plurality of ice piece forming cavities, wherein the water is substantially solidified.

11. The kitchen appliance of claim 9, further comprising:

a barrier coating disposed proximate at least a portion of the inward surface of the conductive ice tray.

12. The kitchen appliance of claim 10, further comprising:

a switch in electrical communication with the power source, the capacitor, and the conductive ice tray, wherein the switch is configured to move between a charging position, wherein the capacitor is configured to selectively receive and store the electrical charge from the power source, a pulse position, wherein the capacitor is configured to selectively release the electrical charge through the conductive ice tray in the form of an electromagnetic pulse, and an idle position, wherein the capacitor is not in electrical communication with the power source or the conductive ice tray.

13. The kitchen appliance of claim 12, further comprising:

a control in electrical communication with the switch and configured to move the switch between the charging, pulse and idle positions, wherein the control is configured to move the switch to the charging position when the electrical charge in the capacitor falls below a predetermined charge, and wherein the control is further configured to move the switch to the pulse position after the electrical charge in the capacitor reaches the predetermined charge and the temperature of the water falls below the predetermined temperature, and wherein the control is further configured to move the switch to the idle position when the temperature of the water has not fallen below the predetermined temperature and the electrical charge in the capacitor has reached the predetermined charge.

14. The kitchen appliance of claim 9, further comprising:

a protruding portion of the conductive ice tray defined by at least one sidewall and at least one bottom surface of the conductive ice tray proximate the at least one bottom surface, wherein the conductive material is a conductive biasing pad disposed within the protruding portion of the conductive ice tray and configured for selective vertical movement within the protruding portion when the first magnetic field is generated about the conductive ice tray; and a biasing cushion disposed proximate at least a portion of an upper surface of the protruding portion and configured to receive a biasing surface of the conductive biasing pad and substantially limit the upward movement of the biasing pad caused by the opposing first and second magnetic fields beyond a predetermined distance, wherein the at least one ice piece is ejected from the plurality of ice piece forming cavities without the addition of at least one of heat and a torsional force applied to the conductive ice tray.

15. The kitchen appliance of claim 9, further comprising:

an ice conveyor configured to selectively direct the at least one ice piece that has been repelled from the conductive ice tray to an ice piece container, wherein the ice piece container is configured to selectively dispense the at least one ice piece from the ice making module through an access aperture, and wherein the ice conveyor includes a rotating member disposed proximate the conductive ice tray, wherein the rotating member is configured to rotate the conductive ice tray after the at least one ice piece has been repelled from the conductive ice tray, wherein the at least one ice piece is gravity fed into the ice piece container.

16. A method for heatless removal of ice pieces from a conductive ice tray comprising steps of:

providing a conductive ice tray including at least one ice piece forming cavity that is defined by at least one sidewall, and at least one bottom surface, wherein the conductive ice tray has an outward surface and an inward surface;

forming at least one ice piece within the at least one ice piece forming cavity using a cooling capacity supplying system, wherein the at least one ice piece is in selective electromagnetic communication with the conductive ice tray;

charging a capacitor configured to selectively receive an electric charge from a power source, wherein the capacitor is in selective electrical communication with the power source and in selective electrical communication with the conductive ice tray; and delivering an electromagnetic pulse from the capacitor through the conductive ice tray, thereby generating an induced electrical current through the at least one ice piece and a repelling electromagnetic force between the conductive ice tray and the at least one ice piece, thereby biasing the at least one ice piece away from the at least one bottom surface of the conductive ice tray, and repelling the at least one ice piece from the at least one ice piece forming cavity.

17. The method of claim 16, further comprising the step of:

conveying the at least one ice piece repelled from the conductive ice tray to an ice piece container using a conveyor mechanism, wherein the ice piece container is configured to dispense the at least one ice piece from an ice making module.

18. The method of claim 16, further comprising the step of:

providing a control in electrical communication with a switch and configured to move the switch between a charging position, wherein the capacitor is in electrical communication with the power source, and a pulse position, wherein the capacitor is in electrical communication with the conductive ice tray, and wherein the control is configured to move the switch to the pulse position after the electric charge in the capacitor reaches a predetermined charge and a temperature of the water falls below a predetermined temperature, and wherein the control is further configured to move the switch to the charging position when the electric charge in the capacitor falls below the predetermined charge.

19. The method of claim 17, wherein a barrier membrane is disposed on at least a portion of the inward surface to provide an at least partial separation between the at least one ice piece and the conductive ice tray.

20. The method of claim 18, wherein the switch includes an idle position, wherein the capacitor is not in electrical communication with the power source or the conductive ice tray, and wherein the control is configured to move the switch to the idle position when the capacitor has stored a predetermined charge and the temperature of the water in the at least one ice piece forming cavity has not fallen below the predetermined temperature.

* * * * *